United States Patent [19]

Salmi et al.

[11] Patent Number: 4,582,145

[45] Date of Patent: Apr. 15, 1986

[54] PRESSURE-MEDIUM DRIVEN PERCUSSION DEVICE

[75] Inventors: Pekka Salmi, Tampere; Timo Muttonen, Nokia, both of Finland

[73] Assignee: Oy Tampella AB, Tampere, Finland

[21] Appl. No.: 536,357

[22] Filed: Sep. 27, 1983

[30] Foreign Application Priority Data

Oct. 8, 1982 [FI] Finland ..... 823439

[51] Int. Cl.[4] ..... E21C 3/00

[52] U.S. Cl. ..... 173/64; 173/132; 173/138

[58] Field of Search ..... 173/132, 57, 133, 59, 173/104–111, 64, 138, 139; 175/296–298; 166/178

[56] References Cited

U.S. PATENT DOCUMENTS 2,226,559 12/1940 Groom ..... 173/133
4,109,734 8/1978 Montabert ..... 173/131
4,366,868 1/1983 Salmi ..... 173/132

FOREIGN PATENT DOCUMENTS 2648389 10/1976 Fed. Rep. of Germany .
60153 12/1981 Finland .

*Primary Examiner*—James M. Meister
*Assistant Examiner*—John L. Knoble
*Attorney, Agent, or Firm*—Ladas & Parry

[57] ABSTRACT

A pressure-medium driven percussion device including a body, a drill shank gliding axially in the body for transmitting percussions to a drill rod and a percussion piston moving in the body for directing percussions axially to the drill shank. The drill shank includes a lifting piston which moves in a lifting cylinder within the body. The body further includes a channel passing to the lifting cylinder for supplying and removing pressure medium into and out of the lifting cylinder and seals located between the body and the drill shank at both sides of the lifting cylinder. An equalizing channel is located between each seal and a corresponding choking slot. A valve connects the equalizing channels to the source of pressure medium when a channel passing to lifting cylinder is connected to a pressure medium container, and, correspondingly, to the pressure medium container when the channel passing to the lifting cylinder is connected to the source of pressure.

5 Claims, 3 Drawing Figures

PRESSURE-MEDIUM DRIVEN PERCUSSION DEVICE

Figure 1:
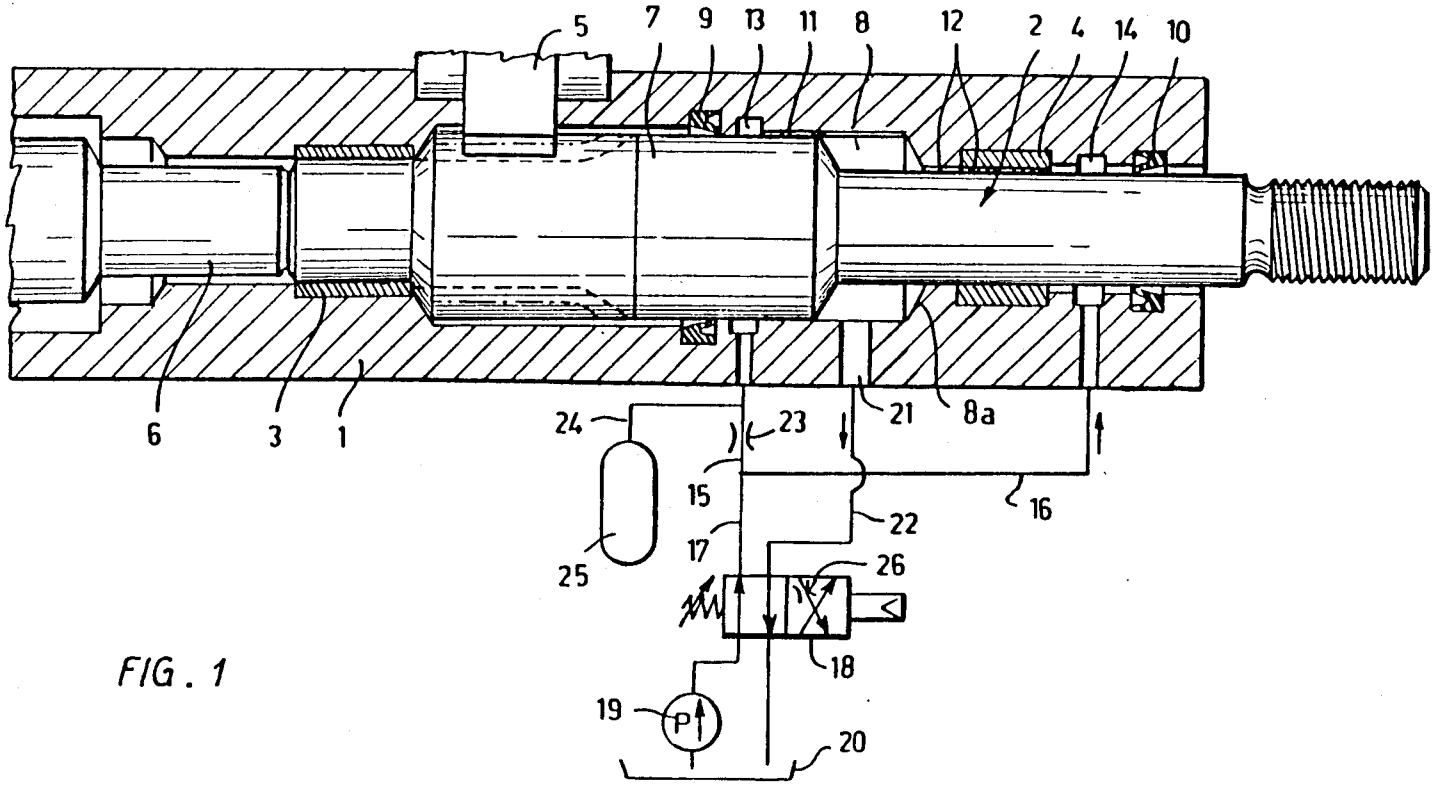

The present invention is concerned with a percussion device, which comprises a body, a drill shank gliding axially in the body for transmitting percussions to the drill rod, a percussion piston moving in the body for directing percussions axially to the drill shank, a lifting piston placed in the drill shank, the said piston moving in a lifting cylinder provided in the body, for lifting the drill shank by means of pressure medium to impact contact with the percussion piston, a channel provided in the body and passing to the lifting cylinder for supplying pressure medium into the lifting cylinder and for removing the said medium out of the lifting cylinder, and seals between the body and the drill shank, placed at both sides of the lifting cylinder, whereat there are slots choking the flow of the pressure medium placed between the body and the drill shank, the said slots being located between the lifting cylinder and the two seals.

A percussion device of this type is used in particular in a rock-drilling machine. The invention can, however, be used, besides in connection with a drilling machine provided with rotation means, also in connection with a percussion device alone.

The function of the lifting-cylinder-piston construction in the percussion device is, by means of pressure medium, to lift the drill shank to impact contact with the percussion piston in particular in connection with jamming of the drill rod, whereat, by taking advantage of the percussion, it is possible to vibrate the drill rod loose from the rock during the return feed of the drill shank.

From the German published Patent Application No. 2,648,389 and from the Finnish Pat. No. 60,153, similar percussion devices provided with a lifting-piston-cylinder construction are previously known. It is a drawback of these prior-art devices that a strong pressure impact is directed at the seals when the percussion piston strikes against the drill shank and the drill rod is not in contact with the rock. As a result of this, the seals may be easily damaged. It is a further drawback that the drill shank or the lifting piston may be struck forcibly against the bottom of the cylinder space, because the pressure fluid may flow relatively freely out of the lifting cylinder during the entire path of movement of the drill shank.

It is an object of the present invention to provide a percussion device which avoids the above drawbacks and prevents the generation of strong impacts. This objective is achieved by means of a percussion device in accordance with the present invention, which is characterized in that in the body, there is an equalizing channel between both seals and the corresponding choking slot, that the channel passing to the lifting cylinder ends in the cylinder wall at a distance from the bottom of the lifting cylinder, and that the device is provided with a valve which connects the equalizing channels to the source of pressure medium when the channel passing to the lifting cylinder is connected to the pressure medium container, and, correspondingly, to the pressure medium container when the channel passing to the lifting cylinder is connected to the source of pressure.

The invention is based on the idea that the access of strong pressure medium impacts to the seals is prevented by means of slots choking the flow and by means of equalizing channels, and the striking of the drill shank against the bottom is prevented by attenuating the movement of the lifting piston by means of a fluid cushion when the lifting piston approaches the bottom of the cylinder space.

Figure 2:
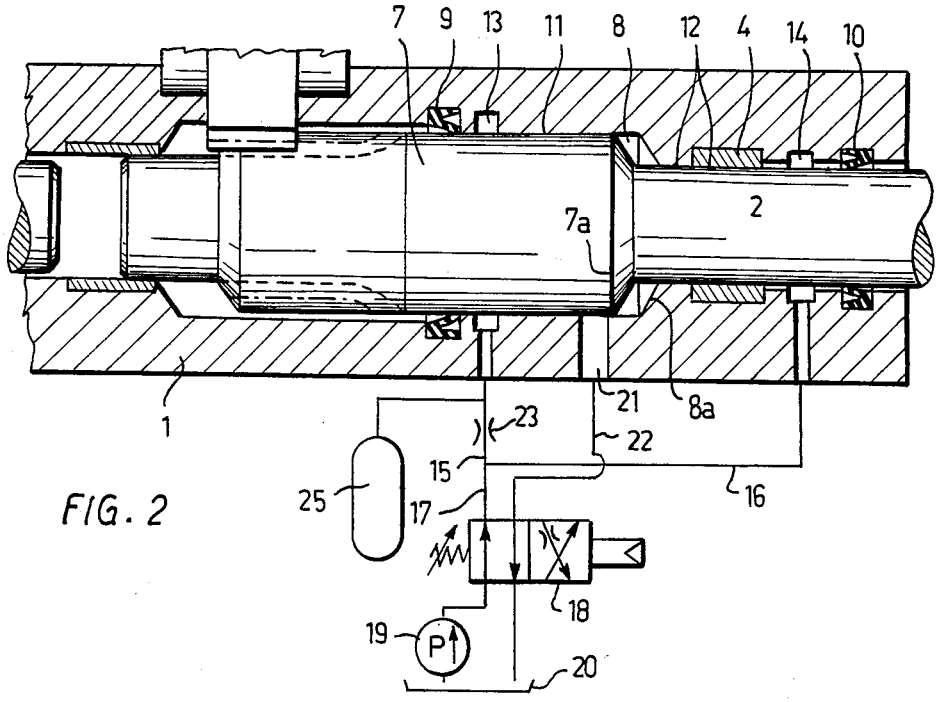
Figure 3:
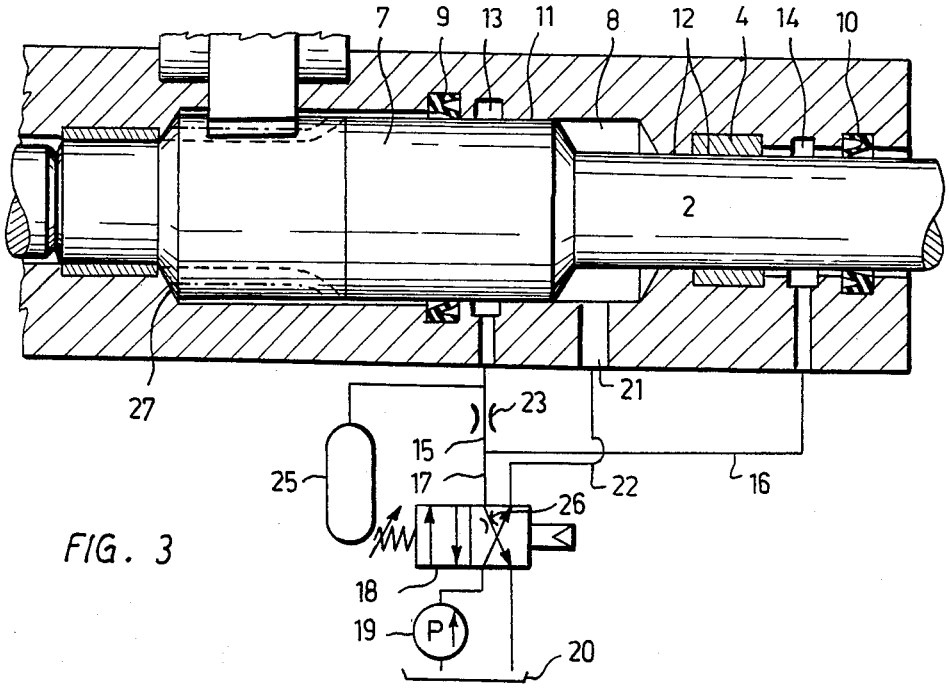

The invention will be described in more detail below with reference to the attached drawings, wherein FIG. 1 shows a preferred embodiment of the percussion device in accordance with the invention as an axial section when the percussion piston is striking against the drill shank, FIG. 2 shows the percussion device when the drill shank is positioned in the extreme position after the impact, and FIG. 3 shows the percussion device when the drill shank is striking against the percussion piston.

The percussion device shown in the drawings comprises a frame 1, to which the drill shank 2 is mounted axially glidably by means of bearings 3,4. The drill shank is rotated around its longitudinal axis by a cogwheel 5 included in the rotating mechanism. As an axial extension of the drill shank, a percussion piston 6 is mounted in the body, the said piston being axially displaceable towards the drill shank and away from the drill shank by means of a pressure fluid system not shown. The threaded end projecting from the body of the drill shank is intended to be fixed to the drill rod.

In the drill shank, a lifting piston 7 is formed, which moves in a lifting cylinder 8 provided in the body. At both sides of the lifting cylinder, seals 9, 10 are fitted in the body, the said seals sealing against the lifting piston and the drill shank, respectively. Between the lifting piston and the body as well as between the drill shank and the body, there are slots 11 and 12, respectively, choking the flow of the pressure fluid.

Between both seals and the related choking slots, according to the invention, annular equalizing channels 13 and 14, respectively, are provided in the body, channels passing from the said annular channels to outside the body. The equalizing channels are connected by means of conduits 15 and 16 to a connecting conduit 17, which passes through a valve 18 alternatively to the pressure medium pump 19 or to the pressure medium container 20.

From the lifting cylinder 8, a pressure medium channel 21 passes to outside the body. The channel 21 is connected by means of a conduit 22 to the said valve and via the valve alternatively to the pump 19 or to the container 20. The pressure fluid channel 21 ends in the wall of the lifting cylinder 8 at a distance from the bottom 8*a* of the cylinder space.

A flow choke 23 is fitted in the conduit 15 in the equalizing channel 13 towards the percussion piston. A pressure accumulator 25 is connected between the choke and the body by means of a conduit 24.

The valve 18 has two positions, whereat, in the first position (normal drilling position) the valve connects the pump 19 to the connecting conduit 17 of the equalizing channels and the conduit 22 of the lifting cylinder to the container 20, and in the other position (lifting position) the valve connects the connecting conduit 17 to the container and the pump to the conduit 22. The valve is provided with a choke 26, which, in the latter position, chokes the flow of the pressure fluid from the connecting conduit to the container.

The percussion device operates as follows:

In a normal drilling situation, FIG. 1, the pump supplies pressure fluid into the connecting conduit 17 and further through the conduits 15 and 16 to ahead of the seals 9 and 10. The choke 23 provided in the conduit 15 causes that most of the pressure fluid flows into the conduit 16 and through the bearing 4 into the lifting cylinder.

If, when the percussion piston strikes against the drill shank, the drill rod is not in contact with the rock but the drill shank may move forwards freely, FIG. 2, the pressure fluid flows from the pressure medium channel 21 of the lifting cylinder freely through the conduit 22 into the container as long as the channel is open. Once the lifting piston has moved far enough so that the edge *7a* of the lifting cylinder has moved beyond the channel 21, the pressure fluid cannot escape any longer, but it forms a fluid cushion in the cylinder, whereat the movement of the lifting piston is stopped and no impact against the bottom is produced. The choking slots 11 and 12 protect the seals 9 and 10, respectively, from pressure impacts.

In the lifting situation, FIG. 3, the pump feeds pressure fluid through the conduit 22 and the pressure fluid channel 21 into the lifting cylinder 8 so that the pressure fluid pushes the drill shank so as to strike against the axial bearing 27 placed in the body.

The pressure accumulator 25 connected to the conduit 15 coming from the equalizing channel 13 ensures that the pressure impacts directed against the seal 9 are not increased by the effect of the choke 23 placed in the conduit.

The choke 26 in the valve ensures that a sufficiently high pressure is maintained in the lifting cylinder in the lifting situation. Normally, a choke 26 is not needed, but, when the effect of the choking slots 11, 12 and of the choke 23 is reduced owing to wear etc., the pressure can, in such a case, be kept sufficiently high. The significance of the chokes is increases along with the wear of the device, so that it is preferable to use an adjustable choke, whose choking effect is adjusted higher on the basis of the number of operating hours. Alternatively, it is possible to use a choke provided, e.g., with an exchangeable bushing in view of producing different choking effects.

The drawings and the related description are intended to illustrate the invention only. In its details, the percussion device in accordance with the invention may show even considerable variation within the scope of the patent claims.

What is claimed is:

1. Percussion device, which comprises a body, a drill shank gliding axially in said body for transmitting percussions to a drill rod, a percussion piston moving in said body for directing percussions axially to said drill shank, a lifting piston formed by said drill shank so that said lifting piston and said drill shank move as one unit, said piston moving in a lifting cylinder provided in said body, for lifting said drill shank by means of pressure medium to impact contact with said percussion piston, a channel provided in said body and passing to said lifting cylinder for supplying pressure medium into said lifting cylinder and for removing said medium out of said lifting cylinder, seals between said body and said drill shank, placed at both sides of said lifting cylinder, slots choking the flow of said pressure medium, placed between said body and said drill shank, each of said slots being located between said lifting cylinder and a respective one of said two seals, and in said body, an equalizing channel between both seals and the corresponding choking slot, said channel passing to said lifting cylinder being provided to end in the cylinder wall at a distance from the bottom of said lifting cylinder, and said device being provided with a valve which connects said equalizing channels to a source of pressure medium when said channel passing to said lifting cylinder is connected to a pressure medium container, and, correspondingly, to said pressure medium container when the channel passing to said lifting cylinder is connected to said source of pressure.

2. Percussion device as claimed in claim 1, wherein a flow choke is placed in the pressure medium conduit passing to the lifting cylinder is connected to the source of pressure.

3. Percussion device as claimed in claim 2, wherein a pressure accumulator is (25) connected to the pressure medium conduit (15) between the equalizing channel (13) located towards the percussion piston (6) and the flow choke (23).

4. Percussion device as claimed in claim 2, wherein another flow choke (26) is placed in the pressure medium conduit (17) between the equalizing channels (13, 14) and the pressure medium container (20).

5. Percussion device as claimed in claim 1, wherein a flow choke (23) is placed in the pressure medium conduit (15, 17) between the equalizing channel (13) located towards the percussion piston (6) and the valve (18).

* * * * *